United States Patent [19]

Adachi et al.

[11] Patent Number: 4,574,115

[45] Date of Patent: Mar. 4, 1986

[54] SILVER HALIDE LIGHT-SENSITIVE MATERIALS HAVING A LAYER OF GRAINS HAVING DYE ABSORBED THEREON

[75] Inventors: Keiichi Adachi; Tadashi Ikeda; Tadaaki Tani, all of Kanagawa, Japan

[73] Assignee: Fuji Photo Film Co., Ltd., Kanagawa, Japan

[21] Appl. No.: 643,202

[22] Filed: Aug. 22, 1984

[30] Foreign Application Priority Data

Aug. 22, 1983 [JP] Japan ..... 58-152961

[51] Int. Cl.[4] ..... G03C 5/24

[52] U.S. Cl. ..... 430/522; 430/510; 430/523; 430/527; 430/950; 430/961

[58] Field of Search ..... 430/950, 961, 503, 510, 430/522, 523, 527

[56] References Cited

U.S. PATENT DOCUMENTS

| | | | |
|---|---|---|---|
| 3,637,676 | 1/1972 | Heseltine | 430/522 |
| 3,652,283 | 3/1972 | Mackey | 430/522 |
| 3,653,905 | 4/1972 | Depoorter et al. | 430/522 |
| 4,275,146 | 6/1981 | Yoneyama et al. | 430/950 |
| 4,343,873 | 8/1982 | Sasaoka | 430/950 |
| 4,409,322 | 10/1983 | Ezaki et al. | 430/950 |
| 4,439,520 | 3/1984 | Kofron et al. | 430/503 |

*Primary Examiner*—Jack P. Brammer

*Attorney, Agent, or Firm*—Sughrue, Mion, Zinn, Macpeak, and Seas

[57] ABSTRACT

A silver halide light-sensitive material is described, comprising (1) an emulsion layer containing light-sensitive silver halide grains, and (2) a layer containing metal salt grains on which a dye is adsorbed, which cannot be substantially developed and are sparingly soluble in water, wherein the absorption maximum of said dye is separated by 20 nm or more from the sensitization maximum of an emulsion layer located in a position farther from the light source than the layer containing said dye.

20 Claims, 7 Drawing Figures

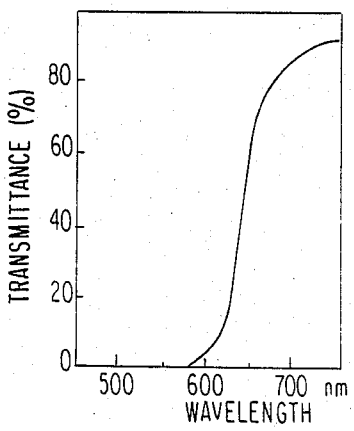
FIG. 1
FIG. 2
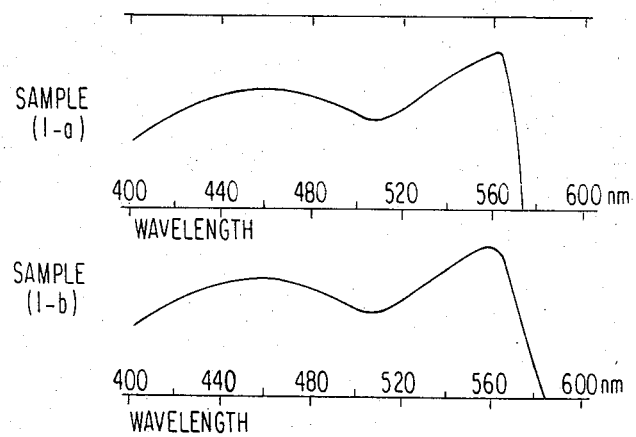
FIG. 3
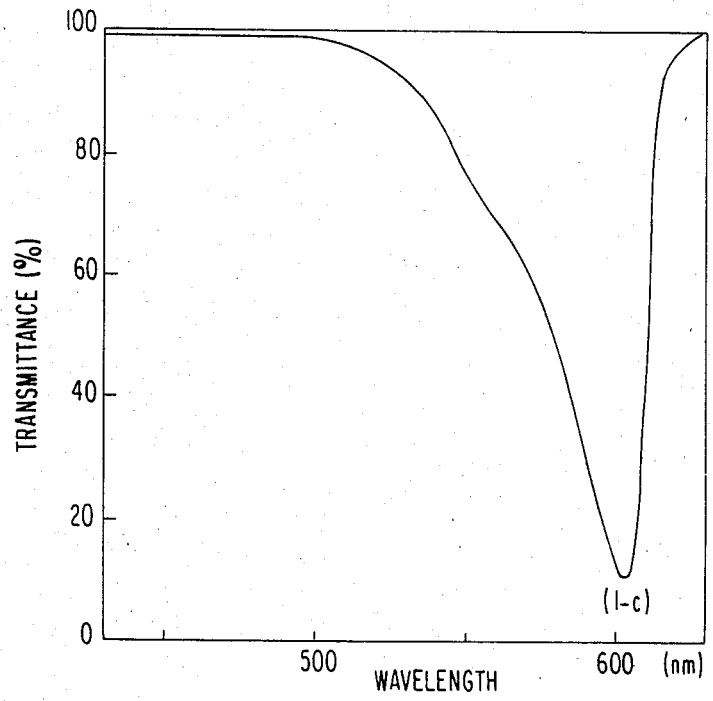
FIG. 5
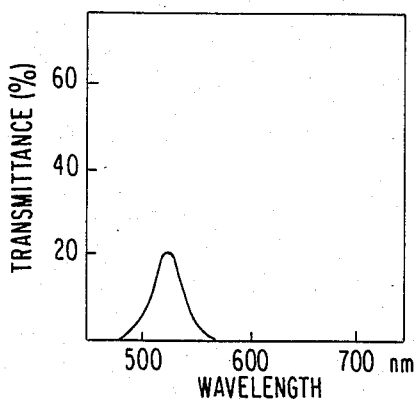

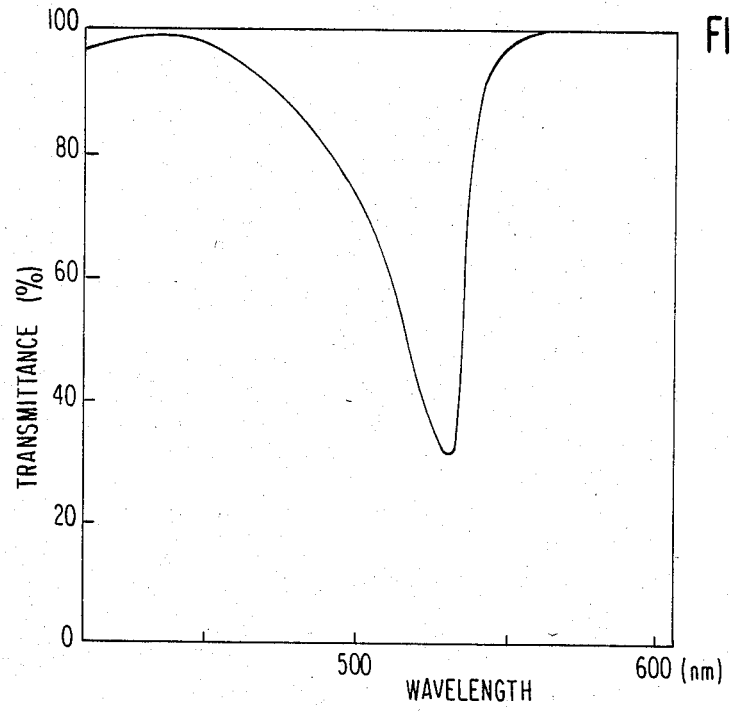
FIG. 4
FIG. 6
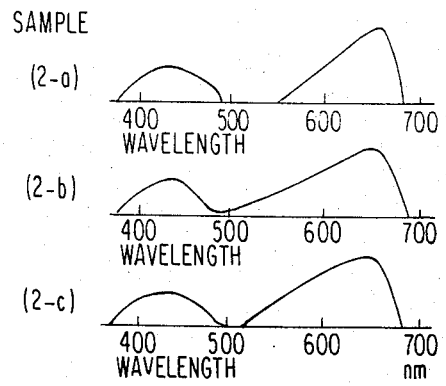
FIG. 7
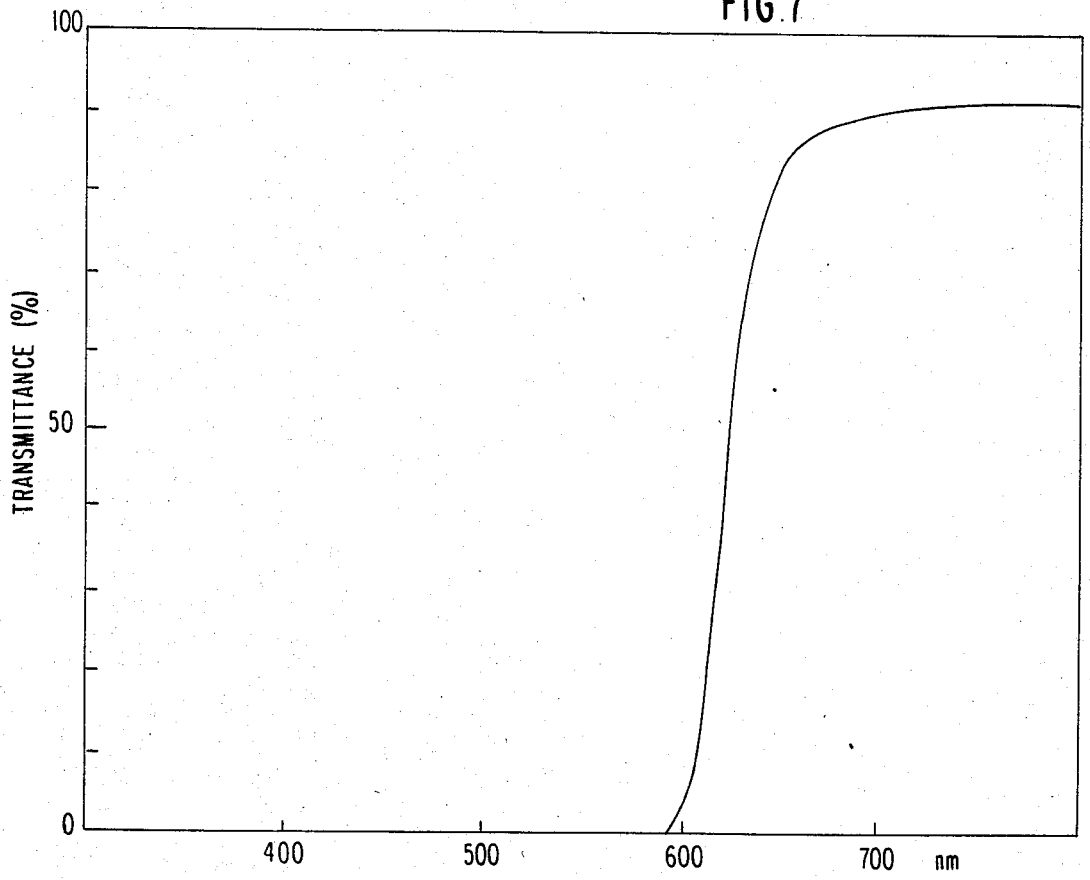

SILVER HALIDE LIGHT-SENSITIVE MATERIALS HAVING A LAYER OF GRAINS HAVING DYE ABSORBED THEREON

FIELD OF THE INVENTION

The present invention relates to silver halide light-sensitive materials containing an incorporated light filter, and particularly a light filter layer having a sharp absorption.

BACKGROUND OF THE INVENTION

Light filters in color light-sensitive materials and monochromatic light-sensitive materials are used for absorbing light having an unnecessary or undesired spectrum region, for example, for (1) control of the spectrum region of incident light for each color-sensitive layer in color light-sensitive materials or (2) giving safe light aptitude in, mainly, monochromatic light-sensitive materials. In either case, it is expected that the filter should cause distinct separation of light, namely, it absorbs light having a spectrum region desired to be absorbed, but allows the desired light to pass. However, the filter layer practically used ordinarily has a somewhat broad shaped absorption curve, which gently extends from the absorption maximum towards the shorter wave side and the longer wave side, and it is inevitable that, if it is intended to sufficiently absorb the light having a certain spectrum region, a part of light in other spectrum regions is undesirably absorbed.

Generally, since filter dyes are suitable to be decolorized after a series of processing steps for development, they are generally selected so as to be somewhat water-soluble. In such a case, they sometimes cause an unsuitable effect by diffusing into other adjacent layers, because they are soluble in water. As a technique for preventing it, it has been known to fix the filter dye with an immobile mordanting agent. However, it is inevitable that one of the dye and the mordanting agent has a cationic group which has an adverse influence upon photographic emulsions, because mordanting is carried out by an electrostatic interaction.

SUMMARY OF THE INVENTION

An object of the present invention is to provide silver halide light-sensitive materials having a light filter layer by which the above described various problems are overcome.

Other objects of the present invention are to provide silver halide light-sensitive materials having a light filter layer which has a sharp spectral transmittance curve, which does not have an adverse infleunce upon silver halide emulsion, and which is easily decolorized during development processing.

The above described objects of the present invention can be attained by a silver halide light-sensitive material comprising (1) an emulsion layer containing light-sensitive silver halide grains, and (2) a layer containing metal salt grains on which a dye is adsorbed and which cannot be substantially developed and are sparingly-soluble in water ( a light filter layer), wherein the absorption maximum of said dye is separated by 20 nm or more from the sensitization maximum of an emulsion layer located in a position farther from the light source than the layer containing said dye.

BRIEF DESCRIPTION OF THE DRAWINGS

FIG. 1 is a spectral transmittance curve of Fuji safe light filter No. 6 (produced by Fuji Photo Film Co., Ltd.), wherein the ordinate represents transmittance (%) and the abscissa represents wavelength.

FIG. 2 is spectral sensitivity curves of samples (1-a) and (1-b), wherein the ordinate represents sensitivity and the abscissa represents wavelength.

FIG. 3 is a spectral transmittance curve of sample (1-c), wherein the ordinate represents transmittance (%) and the abscissa represents wavelength.

FIG. 4 is a spectral transmittance curve of a filter produced using dye 9 described hereinafter, wherein the ordinate represents transmittance (%) and the abscissa represents wavelength.

FIG. 5 is a spectral transmittance curve of a safe light filter, wherein the ordinate represents transmittance (%) and the abscissa represents wavelength.

FIG. 6 shows spectral sensitivity curves of samples (2-a), (2-b), and (2-c), wherein the ordinate represents sensitivity and the abscissa represents wavelength.

FIG. 7 is a spectral transmittance curve of sharp cut filter SC 62 (produced by Fuji Photo Film, Co., Ltd.), wherein the ordinate represents transmittance (%) and the abscissa represents wavelength.

DETAILED DESCRIPTION OF THE INVENTION

As dyes used in the light filter layer of the present invention, any dye can be used if it is adsorbed on the surface of metal salt grains to give sharp absorption and satisfy the above described requirement for maximum absorption. Examples of such dyes include cyanine dyes, merocyanine dyes, xanthene dyes, oxonol dyes, etc. Particularly, dyes which are adsorbed on the surface of metal salt grains to form a J-associated material are preferred, and cyanine dyes and merocyanine dyes known as sensitizing dyes for silver halide are particularly suitably used.

In order that these dyes exhibit substantially sharp absorption, it is necessary that a greater part thereof has the absorption sharpened by adsorption. If the amount of the dye desorbed at the adsorption equilibrium is large, the absorption broadens.

Accordingly, it is preferred that the molar ratio of dye adsorbed on the metal salt grains (substrate) to dye which is present in a nonadsorbed state in the system of the sensitive material is 9/1 or more.

Examples of dyes used in the light filter layer of the present invention include spectrally sensitizing dyes or pigments described in *Research Disclosure,* Vol. 176 (1978), RD-17643, paragraphs IV and VIII, etc.

In the following, typical examples are described.

The absorption wavelength and the half value width described together with dyes are those obtained by measuring spectral transmittance of samples prepared in the same manner as sample (1-c) in Example 1 below, using each dye and silver halide emulsion (X) prepared by the process described in Example 1. The absorption maximum is shown as λ max and the absorption width at which transmittance is 32% when the absorption maximum is 10% as the transmittance is shown as half-value width.

| Dye | | λ max (nm) | Half-value width (nm) |
|---|---|---|---|
| 1. | 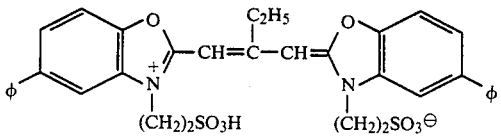 | 549 | 25 |
| 2. | 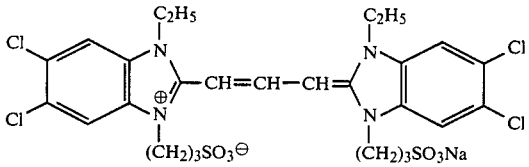 | 583 | 22 |
| 3. | 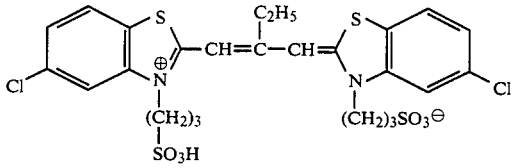 | 630 | 24 |
| 4. | 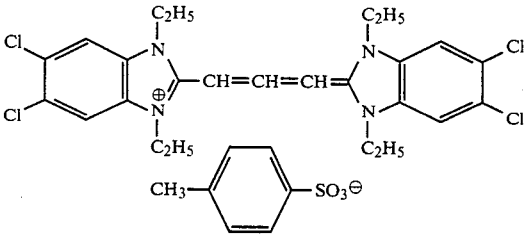 | 585 | 21 |
| 5. | 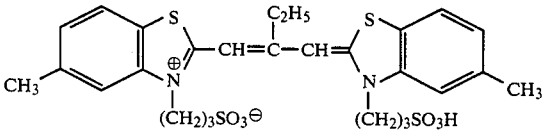 | 648 | 28 |
| 6. | 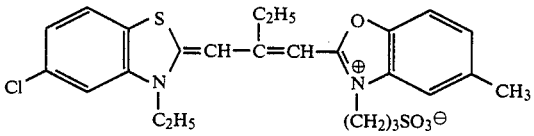 | 600 | 26 |
| 7. | 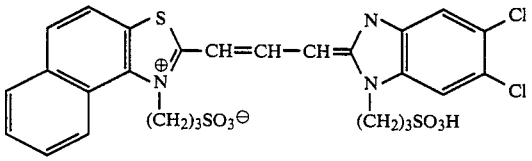 | 620 | 30 |
| 8. | 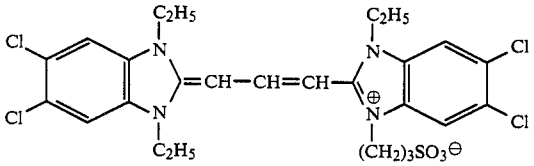 | 585 | 20 |

-continued
| Dye | | λ max (nm) | Half-value width (nm) |
|---|---|---|---|
| 9. | 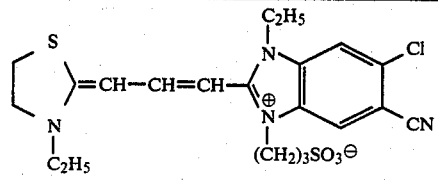 | 530 | 23 |
| 10. | 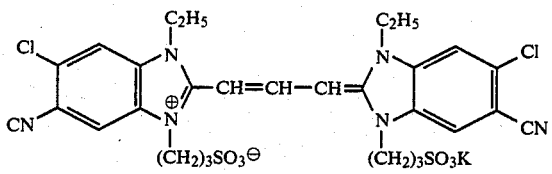 | 616 | 18 |
| 11. | 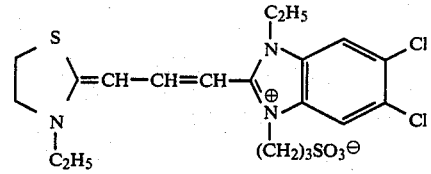 | 512 | 25 |
| 12. | 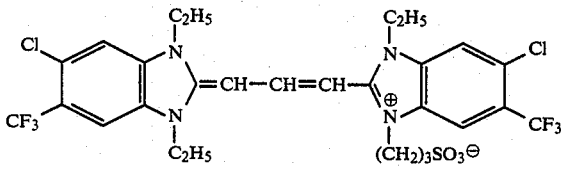 | 572 | 18 |
| 13. | 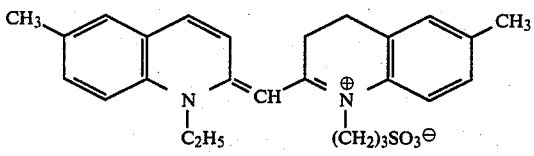 | 578 | 28 |
| 14. | 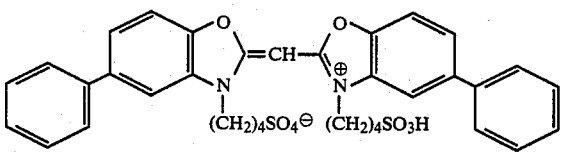 | 460 | 28 |
| 15. | 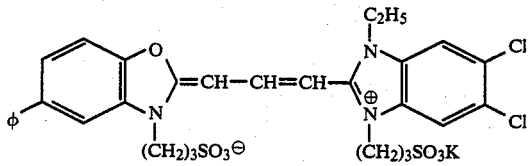 | 560 | 20 |
| 16. | 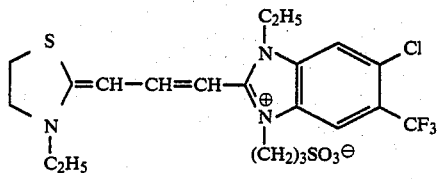 | 510 | 28 |
| 17. | 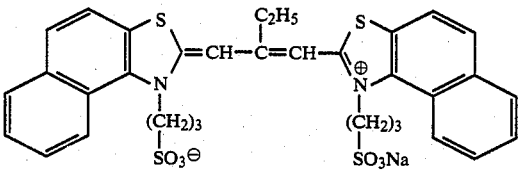 | 688 | 27 |

-continued

| Dye | | λ max (nm) | Half-value width (nm) |
|---|---|---|---|
| 18. | 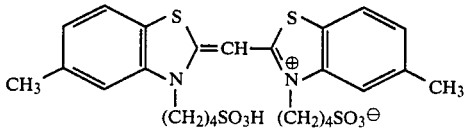 | 468 | 30 |
| 19. | 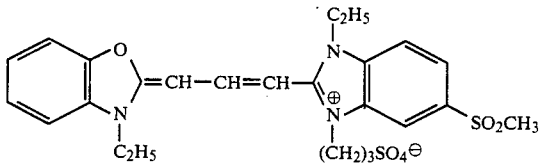 | 521 | 27 |
| 20. | 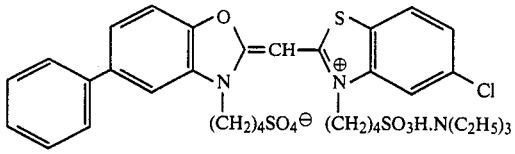 | 460 | 27 |
| 21. | 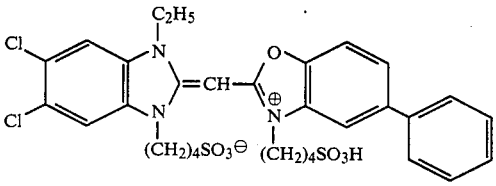 | 426 | 27 |
| 22. | 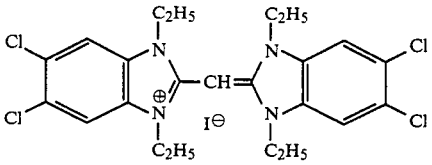 | 430 | 26 |
| 23. | 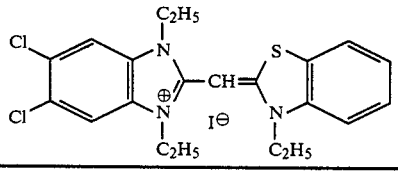 | 440 | 28 |

In the present invention, the amount of the dye added may vary depending upon use, but the dye is generally used in an amount of from $1\times10^{-7}$ to $5\times10^{-1}$ mols, preferably from $1\times10^{-6}$ to $2.5\times10^{-1}$ mols, and more preferably from $4\times10^{-6}$ to $1\times10^{-1}$ mols, per mol of metal salt grains.

In the present invention, as metal salt grains on which the dye is adsorbed, there are oxides and halides of various metals, which are preferred to be eluted during development processing steps (for example, development step, fixing step, etc.), from the viewpoint of decolorization of the dye. Examples thereof include silver halides (for example, silver chloride, silver bromide, silver iodide, and mixed crystals thereof), zinc oxide, lead oxide, titanium oxide, cadmium oxide, copper oxide, tin oxide, thallium halides (for example, thallium chloride, thallium bromide, thallium iodide, etc.), cadmium sulfide, CdSe, etc.

From the point of view of the dye being eluted and decolored during the development processing, silver halides and zinc oxide are preferred and silver halides are particularly preferred.

The grain size of the metal salt grains used in the present invention is not particularly restricted, but it is generally in a range of from 0.01 to 1.0 μ (average diameter), preferably from 0.05 to 0.5 μ, and more preferably from 0.05 to 0.2 μ.

The amount of the metal salt grains used in the present invention is not particularly limited, but is selected depending upon the kind of dye, the amount of dye, the grain size of metal salt grains, and filter density desired; it is generally in a range of from 0.01 to 100 mmols/$m^2$, and preferably from 0.1 to 10 mmols/$m^2$.

It is noted that, in order that the light filter layer functions as a light filter, the metal salt grains on which the dye is adsorbed are not required to have light-sensitivity. Particularly, in black and white photography using reduced silver as images, it is not suitable to form silver images other than the desired images. In this case, in view of the purpose of using the light-sensitive material, it is desired that the metal salt is substantially light-insensitive (non-developable), namely, the image is not substantially formed by development when exposed in an exposure amount practically applied. For such a purpose, in case that the metal salt is, for example, silver halide, a development restrainer can be simultaneously adsorbed with the dye. Examples of the development restrainer include mercapto compounds such as 1-(3-caproamido)phenyl-5-mercaptotetrazole. Further, fine grains (for example, 0.05 to 0.5 μ) of silver halide are preferred for use because they do not have light-sensitivity, and it is possible to obtain a wide adsorption area and to attain easy fixation.

It is desired that the metal salt grains used in the present invention have substantially no light-sensitivity. More specifically, they should have a sensitivity of one tenth or less, preferably one one-hundredth or less, and more preferably one one-thousandth or less, the sensitivity of the light-sensitive emulsion layer.

The light filter would become meaningless, as is obvious from the purpose of it, if it completely absorbed the sensitization range of the emulsion layer located farther from the exposure face than it. Generally, the absorption maximum of the light filter layer and that of the emulsion layer combined therewith are separated by 50 nm or more. However, the present invention can be applied to the case that the absorption maximum of the light filter layer is separated even by only 20 nm from the sensitization maximum of the emulsion layer, because it is easy to provide a sharp absorption of a half-value width of 20 to 30 nm or so.

In certain cases, it may be desired that it does not absorb only the light of very narrow spectrum region, but that it absorbs the light over a wide spectrum region and has an absorption curve having a nearly rectangular shape wherein the ends of the absorption curve are sharply cut. In such cases, it is recommended to use a dye having a comparatively broad absorption (which is not necessarily adsorbed on the inorganic salt) together with the dye having a sharp absorption of the present invention. Of course, it is possible to produce a filter system having a certain degree of width by using two or more kinds of dyes of the present invention.

In the case that the dye is a so-called sensitizing dye, substances corresponding to supersensitizing agents in the case of using sensitizing dyes can be used together with the dye in order to provide easy formation of the associated materials.

For example, in the case of using sensitizing dyes in combination, those described in U.S. Pat. Nos. 2,704,714, 3,522,052, 3,615,609, 3,667,960, 3,672,898, 3,679,428, 3,832,189, 3,854,955, 3,856,532, 3,873,324, 3,973,969, 4,018,610, 4,039,335 and 4,135,933, British Pat. No. 1,321,881, Japanese Patent Application (OPI) Nos. 45717/74 and 14834/72, etc. can be used. In the case of using colorless compounds in combination to make the absorption spectrum sharper, combinations as described in U.S. Pat. Nos. 2,566,167, 3,592,654, 3,592,656, 3,864,134 and 4,030,927, and Japanese Patent Application (OPI) Nos. 104927/75, 77224/76 and 104337/76 can be used.

In the case of using the metal salt grains, it is possible to utilize many techniques known concerning sensitizing dyes, except that the grains should have substantially no developability.

Dyes used in the present invention can be dispersed in a hydrophilic colloid containing metal salts for the light filter layer. They can be added to the hydrophilic colloid in a state of solution by dissolving in a suitable solvent such as methyl alcohol, ethyl alcohol, methyl cellosolve, acetone, water, pyridine, or a mixed solvent thereof. Ultrasonic waves can be used to facilitate dissolution. As processes for adding the sensitizing dyes, it is possible to utilize a process which comprises dissolving the dye in a volatile organic solvent, dispersing the resulting solution in a hydrophilic colloid, and adding the resulting dispersion to an emulsion, as described in U.S. Pat. No. 3,469,987; a process which comprises dispersing a water-insoluble dye in a water-soluble solvent without dissolving, and adding the resulting dispersion to an emulsion, as described in Japanese Patent Publication No. 24185/71; a process which comprises dissolving the dye in a surface active agent and adding the resulting solution to an emulsion, as described in U.S. Pat. No. 3,822,135; a process which comprises dissolving the dye in a compound causing red-shifting and adding the resulting solution to an emulsion, as described in Japanese Patent Application (OPI) No. 74624/76; and a process which comprises dissolving the dye in an acid which does not substantially contain water and adding the resulting solution to an emulsion, as described in Japanese Patent Application (OPI) No. 80826/75. In addition, processes as described in U.S. Pat. Nos. 2,912,343, 2,996,287, 3,342,605 and 3,429,835, can be used for addition to the hydrophilic colloid.

According to the present invention, mixing of colors caused by overlapping foot parts of sensitization spectrum regions of each layer can be prevented by applying to the surface protective layer and/or as one or interlayers in the color light-sensitive materials. Further, it is possible to prepare black and white light-sensitive materials capable of processing in the light room by applying to the surface protective layer so as to selectively absorb only rays emitting by safe light. As examples of being capable of applying to such a purpose, there are conventional litho-light-sensitive materials for processing in the light room and sensitive materials having sensitivity to infrared rays. Particularly, in the sensitive material on which recording is carried out using laser light having a sharp spectral distribution, much information can be recorded on the sensitive material using a plurality of, especially many of, laser lights so as to sharply cut the spectral sensitization regions. For example, it is possible to produce color light-sensitive materials using four colors (wherein the light source is not always restricted to laser light). Further, it is possible to effectively reduce the cross-over light by applying it between the emulsion layer and the support of X-ray sensitive materials.

The present invention is applicable to a photographing system or a printing system, a negative development system or a reversal development system, a conventional system or a diffusion transfer system, negative emulsions or direct reversal emulsions, wet processing or dry processing, normal temperature processing or thermal development, etc. Likewise, in color light-sensitive materials, it can be used irrespective of factors such as species of coloring matters such as couplers, etc., antifading agents and other additives, or dispersion media for coloring matters, etc.

However, in color sensitive materials or diffusion transfer type sensitive materials wherein final images are not formed on the emulsion layer, the adsorption substrate (metal salt) for the filter dye may have sensitivity. However, if it directly contributes to the formation of images, the desired object is lost. Accordingly, it is necessary that, in the color sensitive materials, coloring matters such as couplers are not contained in the layer (2), or that, in case of positive working sensitive materials utilizing undeveloped silver halide for formation of images, irrespective of color sensitive materials and black and white sensitive materials, silver halide in the light filter layer is previousl fogged or is fogged during development processing.

In photographic emulsion layers of the photographic light-sensitive materials of the present invention, any of silver bromide, silver iodobromide, silver iodochlorobromide, silver chlorobromide, and silver chloride may be used as silver halide.

Silver halide grains in the photographic emulsions may have a regular crystal form such as cubic or octahedral form, or an irregular crystal form such as spherical or plate-like form, or they may have a mixture of these crystal forms. They may be composed of a mixture of grains in different forms.

The silver halide grains may have heterogeneous phase wherein the inside and the surface layer are composed of different phases, or may be composed of a homogeneous phase. Further, they may be grains wherein latent images are formed mainly on the surface or may be grains wherein the latent images are formed mainly inside the grains.

Photographic emulsions used in the present invention can be prepared by processes as described in P. Glafkides, *Chimie et Physique Photographique* (Paul Montel Co., 1967); G. F. Duffin, *Photographic Emulsion Chemistry* (The Focal Press, 1966); V. L. Zelikman et al, *Making and Coating Photograhic Emulsions* (The Focal Press, 1964), etc.

In the step of formation or physical ripening of silver halide grains, cadmium salts, zinc salts, lead salts, thallium salts, iridium salts or complex salts thereof, rhodium salts or complex salts thereof, iron salts or complex salts thereof, etc., may be allowed to coexist.

In order to remove soluble salts from the emulsion after formation of precipitates or after physical ripening, gelatin may be gelatinized, or a floculation process utilizing inorganic salts, anionic surfactants, anionic polymers (for example, polystyrenesulfonic acid), or gelatin derivatives (for example, acylated gelatin or carbamoylated gelatin, etc.) may be used, too.

The silver halide emulsion are usually chemically sensitized. In order to carry out chemical sensitization, processes as described, for example, in *Die Grundlagen der Photographischen Prozesse mit Silberhalogeniden,* edited by H. Frieser (Akademische Verlagsgesellshcaft, 1968) pages 675–734 can be used.

More specifically, a sulfur sensitization process using sulfur containing compounds capable of reacting with active gelatin or silver (for example, thiosulfates, thioureas, mercapto compounds, and rhodanines), a reduction sensitization process using reductive substances (for example, stannous salts, amines, hydrazine derivatives, formamidinesulfinic acids and silane compounds), a noble metal sensitization process using noble metal compounds (for example, gold complex salts and complex salts of the group VIII metals such as Pt, Ir or Pd, etc.), etc., can be used alone or in combination.

Examples of sulfur sensitization processes are described in U.S. Pat. Nos. 1,574,944, 2,410,689, 2,278,947, 2,728,668, 3,656,955, etc.; examples of reduction sensitization processes are described in U.S. Pat. Nos. 2,419,974, 2,983,609 and 4,054,458, etc.; and examples of noble metal sensitization processes are described in U.S. Pat. Nos. 2,399,083 and 2,448,060 and British Pat. No. 618,061, etc.

As a binder or a protective colloid for the photographic emulsions, gelatin is advantageously used, but other hydrophilic colloids can be used, too.

For example, it is possible to use protein derivatives, such as gelatin derivatives, graft polymers of gelatin and other polymers, albumin or casein, etc.; saccharose derivatives, such as cellulose derivatives (e.g., hydroxyethyl cellulose, carboxymethyl cellulose, cellulose sulfates, etc.), sodium alginate or starch derivatives, etc.; and various synthetic hydrophilic polymers such as homopolymers or copolymers (e.g., polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.).

In the photographic emulsions used in the present invention, various compounds may be incorporated for the purpose of preventing fogging during production, storage, photographic processing, or stabilizing photographic properties. Namely, it is possible to add many compounds known as antifoggants or stabilizers, such as azoles, for example, benzothiazolium salts, nitroindazoles, triazoles, benzotriazoles, and benzimidazoles (particularly, nitro- or halogen substituted compounds); heterocyclic mercapto compounds, for example, mercaptothiazoles, mercaptobenzothiazoles, mercaptobenzimidazoles, mercaptothiadiazoles, mercaptotetrazoles (particularly, 1-phenyl-5-mercaptotetrazole) and mercaptopyrimidines; heterocyclic mercapto compounds having water soluble groups such as a carboxyl group or a sulfo group, etc.; thioketo compounds, for example, oxazolinethione; azaindenes, for example, tetraazaindenes (particularly, 4-hydroxy substituted (1,3,3*a*,7)tetraazaindenes); benzenethiosulfonic acids; benzenesulfinic acids, etc.

More detailed examples and the methods of using them are described, for example, in U.S. Pat. Nos. 3,954,474, 3,982,947, and 4,021,248, and Japanese Patent Publication No. 28660/77.

The photographic emulsions used in the present invention may be spectrally sensitized with methine dyes or others. These sensitizing dyes may be used alone, or they may be used in combination. Combinations of sensitizing dyes are often used, particularly for supersensitization. The emulsions may contain dyes which do not have a spectral sensitization function themselves or substances which do not substantially absorb visible light, but which provide supersensitization when used together with the sensitizing dye.

Useful sensitizing dyes, combinations of dyes showing supersensitization, and substances providing supersensitization are described in *Research Disclosure,* Vol. 176, RD-17643 (Dec. 1978) page 23, IV-J.

The photographic emulsion layers in the photographic light-sensitive materials of the present invention may contain color forming couplers, namely, compounds capable of causing color formation by oxidative coupling with an aromatic primary amine developing agent (for example, phenylenediamine derivatives or aminophenol derivatives, etc.) in color development processing. Examples of magenta couplers include 5-pyrazolone couplers, pyrazolobenzimidazole couplers, cyanoacetyl coumarone couplers, open-chain acrylacetonitrile couplers, etc.; examples of yellow couplers include acylacetamide couplers (for example, benzoylacetanilides and pivaloylacetanilides), etc.; and examples of cyan couplers include naphthol couplers, phenol couplers, etc. Of these couplers, nondiffusible couplers having a hydrophobic group called a ballast group in the molecule are preferred. The couplers may be either 4-equivalent or 2-equivalent to silver ion. Further, colored couplers having an effect of color correction and couplers which release a development restrainer by development (the so-called DIR couplers) may be used.

Further, they may contain noncoloring DIR coupling compounds which form a colorless product by a coupling reaction to release a development restrainer, in addition to the DIR couplers.

In the silver halide light-sensitive materials of the present invention, whitening agents, oils, dyes, hardeners, coating aids, antistatic agents, development controllers, plasticizers, lubricants and matting agents, etc., as described in *Research Disclosure,* Vol. 176, RD17643, Dec., 1978, can be used.

In order to carry out photographic processing of the light-sensitive materials of the present invention, any of known processes and known processing solutions, as described, for example, in *Research Disclosure,* Vol. 176, RD-17643 (Dec., 1978), pages 28–30, can be utilized. The photographic processing may be either the photographic processing of forming silver images (black and white photographic processing) on the photographic processing of forming dye images (color photographic processing), according to the particular desired purpose. The processing temperature is selected generally between 18° C. and 50° C., but a temperature of lower than 18° C. or a temperature above 50° C. may be utilized.

EXAMPLE 1

To a silver iodobromide photographic emulsion having an average grain size of 0.7 μ containing 3 mol % of iodine ion which was prepared by a conventional process (Trivelli and Smith's process described in *Photography and Journal,* Vol. 79, page 230 (1939)) and chemically sensitized with a sulfur compound and a gold compound, the dye (A-1) was added as a sensitizing dye in an amount of $4.0\times10^{-4}$ mols per mol of silver halide. This emulsion was applied to a subbed polyethylene terephthalate film having a thickness of 0.18 mm so as to result in a dry thickness of 5 μ. To a silver halide emulsion (X) prepared by the following formulation which did not substantially have photographic sensitivity, dye 8 was added in an amount of $3.2\times10^{-3}$ mols per mol of silver halide, and sodium dodecylsulfate (1% aqueous solution) was added in an amount of 20 ml per kg of the emulsion, and the resulting emulsion was applied to the above described emulsion layer so as to form a thin layer.

The silver halide emulsion (X) was prepared as follows. Namely, 1000 ml of a 3% aqueous solution of gelatin kept at 50° C. was well stirred, and 750 ml of a lN aqueous solution of silver nitrate and a lN aqueous solution of KBr were simultaneously added over 40 minutes to the above described solution. The silver electric potential during the reactions was kept at −30 mV to prepare an emulsion of spherical AgBr grains having a diameter of 0.15 μm. After this emulsion was desalted, the total amount was made 1 l with water, and 40 g of gelatin was added. The pH and pAg at 50° C. were adjusted to 6.3 and 8.3, respectively.

Thus, sample (1-a) was produced.

Likewise, a sample was prepared by applying the same layer except without adding dye 8, which was referred to as sample (1-b).

To the silver halide emulsion (X), dye 8 was added in an amount of $3.2\times10^{-3}$ mols per mol of silver halide and sodium dodecylsulfate (1% aqueous solution) was added in an amount of 20 ml per kg of the emulsion. The resulting emulsion was applied to the above described polyethylene terephthalate film so as to have a dry thickness of 3 μ to prepare a sample.

This sample was referred to as sample (1-c).

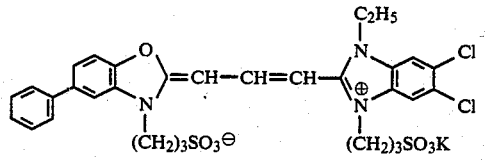

Smax = 560 nm

A 20 W tungsten lamp was covered with Fuji safe light filter No. 6 having a spectral transmittance curve shown in FIG. 1 produced by Fuji Photo Film Co., Ltd. to produce a light source for the safe light test.

Samples (1-a) and (1-b) were allowed to stand for 10 minutes at a distance of 1 m from the light source. After they were subjected to development processing at a temperature of 20° C. for 1 minute with a developing solution having the following formulation, they were fixed, washed with water, and dried in the conventional manner.

| Developing Solution Formulation: | |
|---|---|
| p-Methylaminophenol sulfate | 1 g |
| Anhydrous sodium sulfite | 15 g |
| Hydroquinone | 4 g |
| Sodium carbonate (monohydrate) | 27 g |
| Potassium bromide | 0.7 g |
| Water to make | 1000 cc |

The light fog density of each sample was as shown in Table 1.

TABLE 1

| Sample | Fog of exposed sample (a) | Fog of unexposed sample (b) | Light fog (a)-(b) |
|---|---|---|---|
| 1 - a | 0.06 | 0.05 | 0.01 |
| 1 - b | 0.42 | 0.05 | 0.37 |

According to the present invention, light fogging caused by the safe light was hardly observed.

On the other hand, samples (1-a) and (1-b) were examined by a tungsten lamp having a color temperature of 2854° K. as a light source using a spectrograph having diffraction grating as a spectroscope to obtain wedge spectrograms (spectral sensitivity curves). The resulting spectrograms are shown in FIG. 2. The spectral transmittance curve of sample (1-c) is shown in FIG. 3. It is understood that sensitivity of the desired spectral sensitivity region does not decrease much, while spectral sensitivity of the unnecessary longer wavelength side decreases significantly, because absorption of the dye of the present invention is very sharp.

EXAMPLE 2

To the same silver iodobromide photographic emulsion as that used in Example 1, anhydro-3,3'-disulfopropyl-5,5'-dichloro-9-ethylbenzothiocarbocyanine hydroxide (A-2) (Smax=655 nm) was added as the sensitizing dye in an amount of $3.0\times10^{-4}$ mols per mol of silver halide. This emulsion was applied to a subbed polyethylene terephthalate film having a thickness of 0.18 mm so as to result in a dry film thickness of 5 $\mu$.

To the same silver halide emulsion (X) as that used in Example 1, dye 9 was added in an amount of $2.5\times10^{-3}$ mols per mol of silver halide, and sodium dodecylsulfate (1% aqueous solution) was added in an amount of 20 ml per kg of the emulsion. The resulting emulsion was applied to the above described emulsion layer so as to form a thin layer.

The resulting sample was referred to as sample (2-a).

For comparison, sample (2-b) was prepared using dye (B-1) having the following formula instead of dye 9.

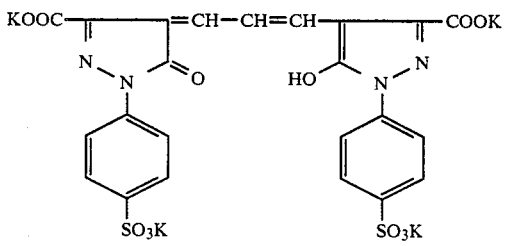

(B-1)

Likewise, sample (2-c) was prepared without using the dye 9. These samples were subjected to a safe light exposure test in the following manner.

Namely, a 20 W tungsten lamp was covered with a safe light filter having a spectral transmittance curve shown in FIG. 5 to prepare a light source for the safty light test. The above described samples (2-a), (2-b), and (2-c) were allowed to stand for 5 minutes at a distance of 1 m from the light source. After they were developed at 20° C. for 3 minutes with a developing solution having the following formulation, they were fixed, washed with water, and dried by the conventional manner. In order to determine development fog, samples which were not exposed to light were subjected to similar development processing.

| Developing Solution Formulation: | |
|---|---|
| Anhydrous sodium sulfite | 50 g |
| Hydroquinone | 12 g |
| Anhydrous sodium carbonate | 60 g |
| 1-Phenyl-3-pyrazolidone | 0.5 g |
| Potassium bromide | 2 g |
| Benzotriazole | 0.2 g |
| Water to make | 1 liter |

The fog density of each sample measured by a P-type photographic densitometer produced by Fuji Photo Film Co., Ltd. was as shown in Table 2.

TABLE 2

| Sample | Fog of exposed sample (a) | Fog of unexposed sample (b) | Light fog (a)-(b) |
|---|---|---|---|
| 2 - a | 0.08 | 0.06 | 0.02 |
| 2 - b | 0.56 | 0.06 | 0.50 |
| 2 - c | 0.41 | 0.06 | 0.35 |

In the sample (2-b) using the known dye which was not adsorbed on silver halide, the fog to safe light ratio was rather great as compared with that in the sample (2-c) using no dye. In sample (2-a) according to the present invention, light fogging caused by the safe light was hardly observed.

On the other hand, a wedge spectrogram (spectral sensitivity curve) of each sample was obtained in the same manner as in Example 1. The resulting spectrograms are shown in FIG. 6.

In comparative sample (2-b), not only was the spectral sensitivity at 640 nm and in the neighborhood thereof lowered as compared with that of the sample (2-c) using no dye, but also the spectral sensitivity became flat in the shorter wavelength side, and particularly the spectral sensivity region expanded to the region of 500 to 520 nm.

According to the present invention, light in the region of 500 to 540 nm was effectively blocked, and sensitivity at 640 nm and in the neighborhood thereof hardly lowered. In order to determine the spectral sensitization rate in 640 nm, each sample was exposed to a tungsten lamp having 2854° K. as a light source through an interference filter having a maximum transmission wavelength of 640 nm (half-value width: 5 nm) and a photographic light wedge (difference of density between steps: 0.15) placed just before the sample, and it was then subjected to the development processing as described above.

The resulting red light sensitivities were as follows. The value of sensitivity is based on the exposure at which the effective density from which fog is removed becomes 0.2, which is shown in Table 3 as a relative value to the sensitivity of sample (2-c).

TABLE 3

| Sample | Red relative sensitivity |
|---|---|
| 2 - a | 0.98 |
| 2 - b | 0.82 |
| 2 - c | 1.00 |

In the sample (2-a) according to the present invention, light fogging remarkably lowered, but sensitivity was not lowered.

EXAMPLE 3

To 700 g of a negative photographic emulsion composed of 77 g of silver iodobromide containing 5 mol % of iodine ion having an average grain size of 0.55 $\mu$, 50 g of gelatin and 600 ml of water, 300 g of a 6.0 weight % aqueous solution of gelatin was added, and a solution prepared by dissolving $1\times10^{-4}$ mol of the same sensitizing dye (A-2) as that used in Example 2 in 120 ml of methanol was added thereto, and then 20 ml of a 0.5% aqueous solution of 5-methyl-7-hydroxy-1,3,4-triazaindolidine was added thereto. On the other hand, 1 g of the cyan coupler N-n-dodecyl-1-hydroxy-2-naphthoic acid amide was dissolved in a mixture of 1 ml of dibutyl phthalate and 2 ml of ethyl acetate with heating, and the resulting solution was dispersed by emulsifying in 10 g of a 10 weight % solution of gelatin in the presence of 1.2 ml of a 5% aqueous solution of sodium dodecylsulfate. The resulting coupler emulsified dispersion was added to the above described emulsion in an amount of 0.2 mol of coupler per mol of silver halide. Further, 10 ml of a 2% aqueous solution of 1-hydroxy-3,5-dichloro-s-triazine sodium salt and 2 ml of a 4% aqueous solution of saponin were added to the emulsion. The resulting emulsion for the red-sensitive layer was applied to a cellulose triacetate support having an antihalation layer so as to result in a dry film thickness of 4.0 μ. Then, to 300 g of the same fine grain emulsion (X) having substantially no photographic sensitivity as that used in Example 1, 300 g of a 6.0 weight % aqueous solution of gelatin was added, and a solution prepared by dissolving $7.0\times10^{-4}$ mols of dye 10 in 150 ml of methanol was added thereto. The resulting emulsion was applied to the above described layer so as to result in a dry film thickness of 2.0 μ.

Then, to 700 g of a negative photographic emulsion composed of 77 g of silver iodobromide grains containing 4.5 mol % of iodine ion having an average grain size of 0.46μ, 50 g of gelatin and 600 g of water, 300 g of a 6.0 weight % aqueous solution of gelatin was added, and 110 ml of a solution of $1.5\times10^{-3}$ mols/l of the following spectral sensitizing dye (A-3) in methanol and 90 ml of a solution of $1.5\times10^{-3}$ mols/l of sensitizing dye (A-4) represented by the following structure in methanol were added thereto to prepare an emulsion for the green-sensitive layer.

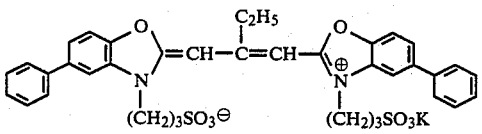
(A-3)

Smax = 550 nm

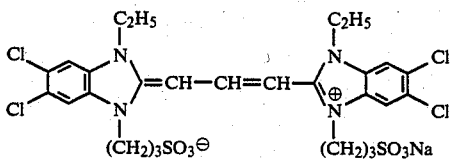
(A-4)

Smax = 582 nm

To the resulting emulsion, 30 ml of a 0.5% aqueous solution of 5-methyl-7-hydroxy-1,3,4-triazaindolidine was added. On the other hand, a solution prepared by dissolving 1.5 g of the magenta coupler 1-(2,4,6-trichloro)phenyl-3-dodecylamido-5-pyrazolone in a mixture of 1.5 ml of tricresyl phosphate and 2 ml of ethyl acetate with heating was dispersed by emulsifying in 10 g of a 10 weight % aqueous solution of gelatin in the presence of sodium dodecylsulfate. The resulting coupler emulsified dispersion was added to the above described emulsion in an amount of 0.23 mol/mol of silver halide. Further, the same hardener as in case of the red-sensitive layer and 10 ml of a 1% solution of sodium dodecylbenzene sulfonate were added thereto. The resulting emulsion for the green-sensitive layer was applied to the red-sensitive layer through the layer containing the above described dye 10 so as to result in a dry film thickness of 4.3 μ. To the resulting layer, a gelatin dispersion prepared by adding yellow colloidal silver containing colloidal silver grains having an average grain size of 0.01 μ and a solution prepared by dissolving $6.5\times10^{-4}$ mols of dye 11 in 75 ml of methanol to 300 g of the above described fine grain emulsion (X) was applied so as to result in a dry film thickness of 1.0 μ.

Then, to 850 g of the same emulsion (average grain size: 0.46 μ) as that used for the green-sensitive layer, 150 g of a 6.0 weight % gelatin solution was added and the following materials were added in the order listed.

400 ml of a 0.5% aqueous solution of 5-methyl-7-hydroxy-1,3,4-triazaindolidine was added. On the other hand, a solution prepared by dissolving 1.5 g of the yellow coupler 4-dodecylbenzoyl-2-methoxy-acetanilide in a mixture of 2.0 ml of dibutyl phthalate and 1.5 ml of ethyl acetate with heating was dispersed by emulsifying in 10 g of a 10 weight % aqueous solution of gelatin in the presence of sodium dodecylsulfate. The resulting coupler emulsified dispersion was added to the above described emulsion in an amount of 0.22 mol of coupler/mol of silver. Further, the same hardener and surfactant as those in the green-sensitive layer were added. The resulting emulsion for the blue-sensitive layer was applied to the above described yellow colloidal silver-gelatin layer so as to result in a dry film thickness of 4.0 μ, and a thin gelatin layer was applied to the resulting layer to form a protective film. This sample was referred to as sample (3-a).

Sample (4-a) was produced by applying a red-sensitive layer, a filter layer, a green-sensitive layer, a yellow colloidal silver/filter layer, a blue-sensitive layer, and a protective layer by the same manner as in sample (3-a), except that (A-5) was used as a spectral sensitizing dye for the red-sensitive emulsion instead of (A-2) in sample (3-a).

Sample (3-b) was produced by applying a red-sensitive layer, a gelatin layer, a green-sensitive layer, a yellow colloidal silver/gelatin layer, a blue-sensitive layer, and a protective layer by the same manner as in sample (3-a), except that the filter layer on the red-sensitive layer was replaced by a gelatin layer and the yellow colloidal silver/filter layer on the green-sensitive layer was replaced by a yellow colloidal silver/gelatin layer. Sample (4-b) was produced by the same manner as in sample (3-b), except that (A-5) was used as a spectral sensitizing dye for the red-sensitive layer instead of (A-2) in sample (3-b).

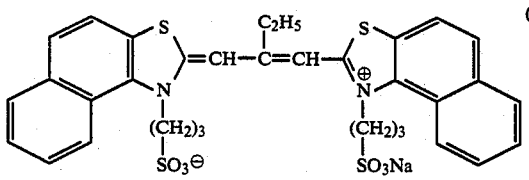
(A-5)

Smax = 685 nm

The above described samples (3-a), (3-b), (4-a), and (4-b) were exposed to light using a tungsten light source having a color temperature of 2854° K. through a magenta wedge and a yellow wedge.

The magenta wedge was produced as follows. A film was prepared by applying the same emulsion for the green-sensitive layer as that used in Sample (3-a) to a cellulose triacetate film support so as to result in a dry film thickness of 4.5 μ, and a gelatin protective layer having a dry film thickness of 1 μ was provided on the resulting layer. The film was exposed to light through a light wedge having continuously changed optical densities, and thereafter it was subjected to color development processing using p-amino-N-ethyl-N-β-methanesulfonamidoethyl-m-toluidine as a color developing agent.

The yellow wedge was produced as follows. A film was prepared by applying the same emulsion for the blue-sensitive layer as that used in sample (3-a) to a cellulose triacetate film support so as to result in a dry film thickness of 4.2 μ, and a gelatin protective layer having a dry film thickness of 1 μ was provided on the resulting layer. The film was exposed to light and subjected to color development processing by the same manner as in the case of producing the magenta wedge.

Exposed samples (3-a), (3-b), (4-a), and (4-b) were subjected to reversal color processing as follows.

| Step | Time | Temperature |
|---|---|---|
| First development | 6 minutes | 38° |
| Water wash | 2 minutes | " |
| Reversal | 2 minutes | " |
| Color development | 6 minutes | " |
| Control | 2 minutes | " |
| Bleach | 6 minutes | " |
| Fixation | 4 minutes | " |
| Water wash | 1 minute | " |
| Stabilization | 4 minutes | Room temperature |

Processing solutions used had the following formulations.

| | |
|---|---|
| First developing solution: | |
| Water | 700 ml |
| Sodium tetrapolyphosphate | 2 g |
| Sodium sulfite | 20 g |
| Hydroquinone monosulfonate | 30 g |
| Sodium carbonate (1 hydrate) | 30 g |
| 1-Phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 2 ml |
| Water to make | 1000 ml (pH 10.1) |
| Reversal solution: | |
| Water | 700 ml |
| Nitro-N,N,N—trimethylenephosphonic acid. 6Na salt | 3 g |
| Stannous chloride (dihydrate) | 1 g |
| p-Aminophenol | 0.1 g |
| Sodium hydroxide | 8 g |
| Glacial acetic acid | 15 ml |
| Water to make | 1000 ml |
| Color developing solution: | |
| Water | 700 ml |
| Sodium tetrapolyphosphate | 2 g |
| Sodium sulfite | 7 g |
| Sodium tertiary phosphate (12 hydrate) | 36 g |
| Potassium bromide | 1 g |
| Potassium iodide (0.1% solution) | 90 ml |
| Sodium hydroxide | 3 g |
| Citrazinic acid | 1.5 g |
| N—Ethyl-N—(β-methanesulfonamidoethyl)-3-methyl-4-aminoaniline sulfate | 11 g |
| Ethylenediamine | 3 g |
| Water to make | 1000 ml |
| Controlling solution: | |
| Water | 700 ml |
| Sodium sulfite | 12 g |
| Sodium ethylenediaminetetraacetate (dihydrate) | 8 g |
| Thioglycerine | 0.4 ml |
| Glacial acetic acid | 3 ml |
| Water to make | 1000 ml |
| Bleaching solution: | |
| Water | 800 g |

-continued

| | |
|---|---|
| Sodium ethylenediaminetetraacetate (dihydrate) | 2.0 g |
| Ammonium iron (III) ethylenediaminetetra-acetate (dihydrate) | 120.0 g |
| Potassium bromide | 100.0 g |
| Water to make | 1000 ml |
| Fixing solution: | |
| Water | 800 ml |
| Ammonium thiosulfate | 80.0 g |
| Sodium sulfite | 5.0 g |
| Sodium bisulfite | 5.0 g |
| Water to make | 1000 ml |
| Stabilizing solution: | |
| Water | 800 ml |
| Formalin (37% by weight) | 5.0 ml |
| Fuji Driwel ® | 5.0 ml |
| Water to make | 1000 ml |

After completion of the photographic processing, the cyan density ($D_{MC}$) and magenta density ($D_{MM}$) of positive images obtained on each sample in the case of exposing to light through the magenta wedge and magenta density ($D_{YM}$) and yellow density ($D_{YY}$) of positive images obtained on each sample in the case of exposing to light through the yellow wedge were measured. Further, cyan density ($d_{MC}$) and magenta density ($d_{MM}$) in the magneta wedge used as an original and magneta density ($d_{YM}$) and yellow density ($d_{YY}$) in the yellow wedge used as an original were measured.

$D_{MC}/D_{MM}$ and $D_{YM}/D_{YY}$ of samples (3-a), (3-b), (4-a), and (4-b) are shown in Table 4 together with $d_{MC}/d_{MM}$ and $d_{YM}/d_{YY}$ of the originals. $D_{MC}/D_{MM}$ and $D_{MC}/D_{MM}$ each indicates a degree of mixing of cyan component in magenta images, and $D_{YM}/D_{YY}$ and $d_{YM}/d_{YY}$ each indicates a degree of mixing of magenta component in yellow images.

TABLE 4

| Sample | Dye | $D_{MC}/D_{MM}$ | $D_{YM}/D_{YY}$ | Notes |
|---|---|---|---|---|
| 3 - a | 10, 11 | 0.053 | 0.017 | The present invention |
| 3 - b | None | 0.115 | 0.054 | Comparison |
| 4 - a | 10, 11 | 0.034 | 0.017 | The present invention |
| 4 - b | None | 0.087 | 0.054 | Comparison |
| | | ($d_{MC}/d_{MM}$) | ($d_{YM}/d_{YY}$) | |
| | | 0.029 | 0.011 | Control |

It is understood from Table 4 that the amount of cyan component formed in the magenta image and the amount of magenta component formed in the yellow image in samples (3-a) and (4-a) according to the present invention are clearly smaller than those in samples (3-b) and (4-b), and the values are not much different from the values $d_{MC}/d_{MM}$ and $d_{YM}/d_{YY}$ of the originals.

Further, samples were exposed to light using a tungsten light source of 2854° K. through Sharp cut filter SC 62 produced by Fuji Photo Film Co., Ltd. (FIG. 7) and a photographic light wedge (difference of density between steps: 0.15) placed just before the sample, and thereafter they were subjected to color reversal development processing as described above. The red light sensitivities obtained were as follows. The value of sensitivity is based on the exposure at which the effective density from which fog is removed becomes 0.2, which is shown in Table 5 as a relative value to the sensitivity of sample (4-b) in case of sample (4-a) or a relative value of sensitivity of sample (3-b) in case of sample (3-a). Reduction of sensitivity according to the present invention is very small as compared with the case of using conventional samples wherein adsorption in silver halide does not occur. It is because the present invention provides a filter layer having a very narrow half-value width and, consequently, the filter layer does not absorb light of the required spectral wavelength region.

TABLE 5

| Sample | Red light relative sensitivity | |
|---|---|---|
| 3 - a | 0.94 | |
| 3 - b | 1.00 | Control |
| 4 - a | 0.97 | |
| 4 - b | 1.00 | Control |

EXAMPLE 4

To a polyethylene terephthalate film support, layers having the following compositions were applied to produce a multilayer color light-sensitive material.

The 1st layer: Antihalation layer

A gelatin layer containing black colloidal silver

The 2nd layer: Interlayer

A gelatin layer containing an emulsified dispersion of 2,5-di-t-octylhydroquinone.

The 3rd layer: The 1st red-sensitive emulsion layer

| | |
|---|---|
| Silver iodobromide emulsion (silver iodide: 5 mol %) Silver amount coated: 1.6 g/m$^2$ | |
| Sensitizing dye (A-2) | $4.5 \times 10^{-4}$ mol per mol of silver |
| Sensitizing dye (A-5) | $1.5 \times 10^{-4}$ mol per mol of silver |
| Coupler EX - 1 | 0.04 mol per mol of silver |
| Coupler EX - 3 | 0.003 mol per mol of silver |
| Coupler EX - 9 | 0.0006 mol per mol of silver |

The 4th layer: The 2nd red-sensitive emulsion layer

| | |
|---|---|
| Silver iodobromide emulsion (silver iodide: 10 mol %) Silver amount coated: 1.4 g/m$^2$ | |
| Sensitizing dye (A-2) | $3 \times 10^{-4}$ mol per mol of silver |
| Sensitizing dye (A-5) | $1 \times 10^{-4}$ mol per mol of silver |
| Coupler EX - 1 | 0.002 mol per mol of silver |
| Coupler EX - 2 | 0.02 mol per mol of silver |
| Coupler EX - 3 | 0.0016 mol per mol of silver |

The 5th layer: Interlayer

The same as the 2nd layer.

The 6th layer: The 1st green-sensitive emulsion layer

| | |
|---|---|
| Silver iodobromide emulsion (silver iodode: 4.0 mol %) Silver amount coated: 1.2 g/m$^2$ | |
| Sensitizing dye (A-3) | $5 \times 10^{-4}$ mol per mol of silver |
| Sensitizing dye (A-4) | $2 \times 10^{-4}$ mol per mol of silver |
| Coupler EX - 4 | 0.05 mol per mol of silver |
| Coupler EX - 5 | 0.008 mol per mol of silver |

-continued

| | |
|---|---|
| Coupler EX - 9 | 0.0015 mol per mol of silver |

The 7th layer: The 2nd green-sensitive emulsion layer

| | |
|---|---|
| Silver iodobromide emulsion (silver iodide: 8 mol %) Silver amount coated: 1.3 g/m$^2$ | |
| Sensitizing dye (A-3) | $3 \times 10^{-4}$ mol per mol of silver |
| Sensitizing dye (A-4) | $1.2 \times 10^{-4}$ mol per mol of silver |
| Coupler EX - 7 | 0.017 mol per mol of silver |
| Coupler EX - 3 | 0.003 mol per mol of silver |
| Coupler EX - 10 | 0.0003 mol per mol of silver |

The 8th layer: Yellow filter layer

A gelatin layer containing yellow colloidal silver and an emulsified dispersion of 2,5-di-t-octylhydroquinone in an aqueous solution of gelatin.

The 9th layer: The 1st blue-sensitive emulsion layer

| | |
|---|---|
| Silver iodobromide emulsion (silver iodide: 6 mol %) Silver amount coated: 0.7 g/m$^2$ | |
| Coupler EX - 8 | 0.25 mol per mol of silver |
| Coupler EX - 9 | 0.015 mol per mol of silver |

The 10th layer: The 2nd blue-sensitive emulsion layer

| | |
|---|---|
| Silver iodobromide emulsion (silver amount coated: 6 mol %) Silver amount coated: 0.6 g/m$^2$ | |
| Coupler EX - 8 | 0.06 mol per mol of silver |

The 11th layer: The 1st protective layer

A gelatin layer containing silver iodobromide (silver iodide 1 mol %, average grain size: 0.07$\mu$, silver amount coated 0.5 g/m$^2$), and an emulsified dispersion of ultraviolet ray absorbing agent UV - 1.

The 12th layer: The 2nd protective layer

A gelatin layer containing polymethyl methacrylate grains (diameter: about 1.5$\mu$).

To each layer, gelatin hardener H-1 and surfactants were added in addition to the above described substances. The thus produced sample was referred to as sample was referred to as sample (5-a).

Compounds used for the sample:

Coupler EX-1

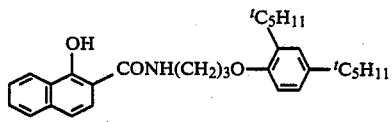

-continued

Coupler EX-2

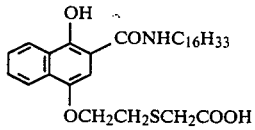

Coupler EX-3

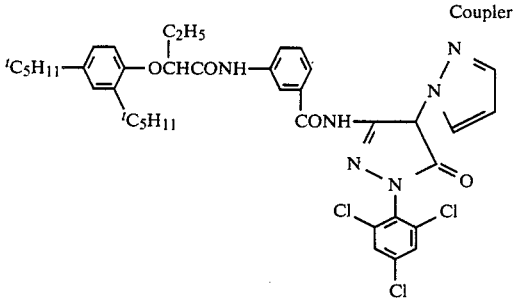

Coupler EX-4

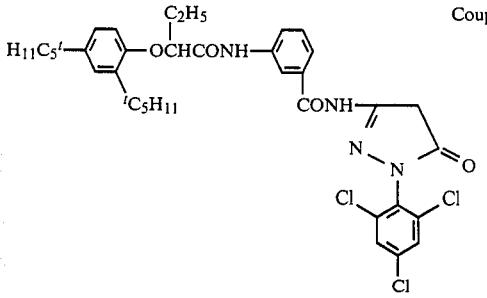

Coupler EX-5

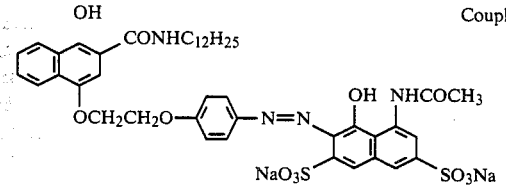

Coupler EX-6

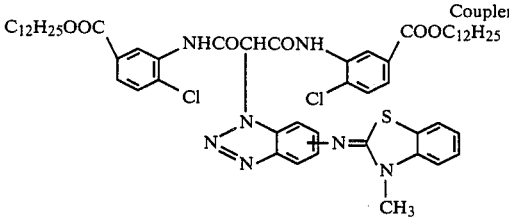

Coupler EX-7

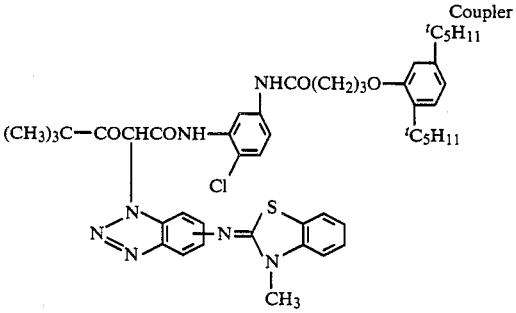

-continued

Coupler EX-8

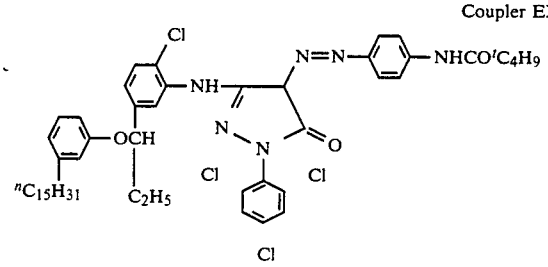

Coupler EX-9

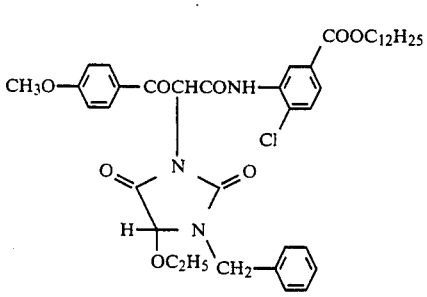

Coupler EX-10

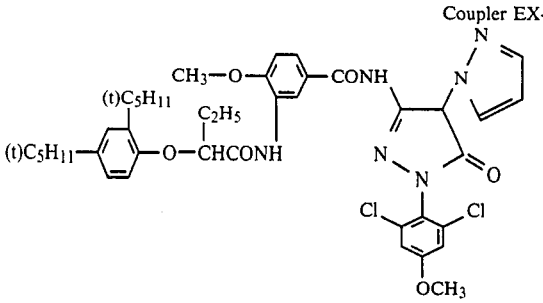

Hardener H-1

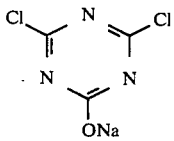

A sample obtained by replacing yellow colloidal silver in the 8th layer of sample (5-a) by the following silver halide fine crystal dispersion was referred to as sample (5-b).

The silver halide fine crystal dispersion was prepared as follows. Namely, to 1000 ml of a 3% aqueous solution of gelatin kept at 50° C., 750 ml of a 1N aqueous solution of silver nitrate and a 1N aqueous solution of KBr were added simultaneously over 40 minutes, with thorough stirring. The silver electric potential was kept at −30 mV during the reaction to prepare an emulsion comprising spherical AgBr grains having a diameter of 0.15 μm. After this emulsion was desalted, the whole amount of it was made to 1 l using water. 40 g of gelatin was added thereto, and the pH and pAg thereof at 50° C. were adjusted to 6.3, respectively. To the resulting emulsion, dye 21 and dye 14 were added in amount of 3.2 mmol/mol-Ag, respectively, and the resulting emulsion was applied so as to result in a dry film thickness of 2.0μ.

A sample obtained by replacing yellow colloidal silver in the 8th layer of sample (5-a) by the following silver halide fine crystal dispersion was referred to as sample (5-c).

The silver halide fine crystal dispersion was prepared as follows. Namely, to 1000 ml of a 3% aqueous solution of gelatin kept at 50° C., 750 ml of a 1N aqueous solution of silver nitrate and a 1N aqueous solution of KBr were added simultaneously over 40 minutes, with thorough stirring. The silver electric potential was kept at −30 mV during the reaction to prepare an emulsion comprising spherical AgBr grains having a diameter of 0.1 μm. After this emulsion was desalted, the whole amount of it was made to 1 l. 40 g of gelatin was added thereto, and the pH and pAg thereof at 50° C. were adjusted to 6.3 and 8.3, respectively. To the resulting emulsion, dye 22 and dye 20 were added in an amount of 4.8 mmol/mol-Ag, respectively, and the resulting emulsion was applied so as to result in a dry film thickness of 2.0μ.

After these samples were exposed to light through a yellow wedge in the same manner as in Example 3, they were subjected to development processing.

The development processing was carried out at 38° C. as follows.

| | |
|---|---|
| 1. Color development | 3 minutes and 15 seconds |
| 2. Bleach | 6 minutes and 30 seconds |
| 3 Water wash | 3 minutes and 15 seconds |
| 4. Fixation | 6 minutes and 30 seconds |
| 5. Water wash | 3 minutes and 15 seconds |
| 6. Stabilization | 3 minutes and 15 seconds |

Processing solutions used in each step had the following formulations.

| | |
|---|---|
| Color developing solution: | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N—Ethyl-N—β-hydroxyethylamino)-2-methylaniline sulfate | 4.5 g |
| Water to make | 1 l |
| Bleaching solution: | |
| Ammonium bromide | 160.0 g |
| Aqueous ammonia (28%) | 25.0 cc |
| Sodium iron salt of ethylenediamine-tetraacetic acid | 130.0 g |
| Glacial acetic acid | 14.0 cc |
| Water to make | 1 l |
| Fixing solution: | |
| Sodium tetrapolyphosphate | 2.0 g |
| Sodium sulfite | 4.0 g |
| Ammonium thiosulfate (70%) | 175.0 cc |
| Sodium bisulfite | 4.6 g |
| Water to make | 1 l |
| Stabilizing solution: | |
| Formalin | 8.0 cc |
| Water to make | 1 l |

Nagenta density ($D_{YM}$) and yellow density ($D_{YY}$) obtained on the samples after the photographic processing were measured. The results are shown in Table 6.

TABLE 6

| Sample | Dye | $D_{YM}D_{MM}$ | Notes |
|---|---|---|---|
| 5 - a | — | 0.12 | Comparison |
| 5 - b | 21, 14 | 0.05 | The present invention |
| 5 - c | 22, 20 | 0.04 | " |

It is clear from Table 6 that in the case of requiring a broad absorption such as is provided by colloidal silver, an effective filter effect can be obtained by using a plurality of dyes.

While the invention has been described in detail and with reference to specific embodiment thereof, it will be apparent to one skilled in the art that various changes and modifications can be made therein without departing from the spirit and scope thereof.

What is claimed is:

1. A silver halide light-sensitive material comprising a support having coated thereon (1) an emulsion layer containing light-sensitive silver halide grains, and (2) a layer containing grains selected from the group consisting of silver halide, zinc oxide, lead oxide, titanium oxide, cadmium oxide, copper oxide, tin oxide, thallium halides, cadmium sulfide and CdSe grains on which a dye which is capable of being adsorbed on said grains so as to give sharp absorption is adsorbed and which cannot be substantially developed and are sparingly soluble in water, wherein the absorption maximum of said adsorbed dye is separated by 20 nm or more from the sensitization maximum of an emulsion layer located in a position farther from the incident light of exposure than the layer containing said dye.

2. A silver halide light-sensitive material as in claim 1, wherein the absorption maximum of said dye is separated by 50 nm or more from the sensitization maximum of said emulsion layer located in a position farther from the light source than the layer containing said dye.

3. A silver halide light-sensitive material as in claim 1, wherein said dye is a cyanine dye or a merocyanine dye.

4. A silver halide light-sensitive material as in claim 2, wherein said dye is a cyanine dye or a merocyanine dye.

5. A silver halide light-sensitive material as in claim 1, wherein the molar ratio of dye adsorbed on the grains to dye which is present in a non-adsorbed state is 9/1 or more.

6. A silver halide light-sensitive material as in claim 1, wherein the grains have a particle size of from 0.01 to 1.0μ and are used in an amount of from 0.01 to 100 mmol/m$^2$, and the dye is used in an amount of from $1\times10^{-7}$ to $5\times10^{-1}$ mols per mol of metal salt grains.

7. A silver halide light-sensitive material as in claim 2, wherein the grains have a particle size of from 0.01 to 1.0μ and are used in an amount of from 0.01 to 100 mmol/m$^2$, and the dye is used in an amount of from $1\times10^{-7}$ to $5\times10^{-1}$ mols per mol of metal salt grains.

8. A silver halide light-sensitive material as in claim 3, wherein the grains have a particle size of from 0.01 to 1.0μ and are used in an amount of from 0.01 to 100 mmol/m$^2$, and the dye is used in an amount of from $1\times10^{-7}$ to $5\times10^{-1}$ mols per mol of metal salt grains.

9. A silver halide light-sensitive material as in claim 4, wherein the grains have a particle size of from 0.01 to 1.0μ and are used in an amount of from 0.01 to 100 mmol/m$^2$, and the dye is used in an amount of from $1\times10^{-7}$ to $5\times10^{-1}$ mols per mol of metal salt grains.

10. A silver halide light-sensitive material as in claim 5, wherein the grains have a particle size of from 0.01 to 1.0μ and are used in an amount of from 0.01 to 100 mmol/m$^2$, and the dye is used in an amount of from $1\times10^{-7}$ to $5\times10^{-1}$ mols per mol of metal salt grains.

11. A silver halide light-sensitive material as in claim 1, wherein the grains have a particle size of from 0.05 to 0.5μ and are used in an amount of from 0.1 to 10 mmol/m$^2$, and the dye is used in an amount of from $1\times10^{-6}$ to $2.5\times10^{-1}$ mols per mol of metal salt grains.

12. A silver halide light-sensitive material as in claim 2, wherein the grains have a particle size of from 0.05 to 0.5μ and are used in an amount of from 0.1 to 10 mmol/m$^2$, and the dye is used in an amount of from $1\times10^{-6}$ to $2.5\times10^{-1}$ mols per mol of metal salt grains.

13. A silver halide light-sensitive material as in claim 3, wherein the grains have a particle size of from 0.05 to 0.5$\mu$ and are used in an amount of from 0.1 to 10 mmol/m$^2$, and the dye is used in an amount of from $1\times10^{-6}$ to $2.5\times10^{-1}$ mols per mol of metal salt grains.

14. A silver halide light-sensitive material as in claim 4, wherein the grains have a particle size of from 0.05 to 0.5$\mu$ and are used in an amount of from 0.1 to 10 mmol/m$^2$, and the dye is used in an amount of from $1\times10^{-6}$ to $2.5\times10^{-1}$ mols per mol of metal salt grains.

15. A silver halide light-sensitive material as in claim 5, wherein the grains have a particle size of from 0.05 to 0.5$\mu$ and are used in an amount of from 0.1 to 10 mmol/m$^2$, and the dye is used in an amount of from $1\times10^{-6}$ to $2.5\times10^{-1}$ mols per mol of metal salt grains.

16. A silver halide light-sensitive material as claimed in claim 1, wherein said grains on which the dye is adsorbed are selected from the group consisting of silver halide and zinc oxide grains.

17. A silver halide light-sensitive material as claimed in claim 16, wherein said grains on which the dye is adsorbed are silver halide grains.

18. A silver halide light-sensitive material as claimed in claim 1, wherein said dye is a dye which is adsorbed on the surface of the grain to form a J-associated material.

19. A silver halide light-sensitive material as claimed in claim 1, wherein said dye is selected from the group consisting of cyanine dyes, merocyanine dyes, xanthene dyes and oxonol dyes.

20. A silver halide light-sensitive material as claimed in claim 1, wherein said dye is selected from the group consisting of cyanine dyes and merocyanine dyes.

* * * * *